US008499572B2

(12) United States Patent
Lim et al.

(10) Patent No.: US 8,499,572 B2
(45) Date of Patent: Aug. 6, 2013

(54) REFRIGERATOR AND CONTROL METHOD THEREOF

(75) Inventors: Jae Hoon Lim, Suwon-si (KR); Seong Ki Jeong, Yongin-si (KR); Jeong Man Nam, Gwangju (KR); Myung Hoon Cho, Gurl-si (KR); Jung Yeob Kim, Gwangju (KR); Jae Koog An, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 809 days.

(21) Appl. No.: 12/654,629

(22) Filed: Dec. 28, 2009

(65) Prior Publication Data

US 2010/0175398 A1 Jul. 15, 2010

(30) Foreign Application Priority Data

Jan. 14, 2009 (KR) ..... 10-2009-0002920

(51) Int. Cl.
*F25C 1/00* (2006.01)
*F25C 5/18* (2006.01)

(52) U.S. Cl.
USPC ..... 62/137; 62/344

(58) Field of Classification Search
USPC ..... 62/137, 344, 351, 353; 700/275
See application file for complete search history.

(56) References Cited

U.S. PATENT DOCUMENTS 7,134,292 B2 * 11/2006 Oh ..... 62/137
7,237,393 B2 * 7/2007 Chung et al. ..... 62/137

FOREIGN PATENT DOCUMENTS

JP 11037621 A * 2/1999
KR 10-2005-0033754 4/2005
KR 10-2005-0110330 11/2005

* cited by examiner

*Primary Examiner* — Chen Wen Jiang
(74) *Attorney, Agent, or Firm* — Staas & Halsey LLP

(57) ABSTRACT

A refrigerator and a control method thereof to control a rotational direction of an ice making motor to detect an ice full state of an ice storage without separating the ice from the ice maker. The refrigerator includes an ice making tray making ice therein, an ejector separating the ice, an ice storage storing the separated ice, an ice full state sensing lever detecting the ice full state of the ice storage, an ice making motor driving the ejector and the ice full state sensing lever, and a controller detecting the ice full state by driving the ice full state sensing lever by rotating the ice making motor in an ice moving direction, and detecting release of the ice full state by driving the ice full state sensing lever by rotating the ice making motor in the opposite direction after the ice full state is detected.

12 Claims, 7 Drawing Sheets

REFRIGERATOR AND CONTROL METHOD THEREOF

CROSS-REFERENCE TO RELATED APPLICATIONS

This application claims the benefit of Korean Patent Application No. 2009-0002920, filed on Jan. 14, 2009 in the Korean Intellectual Property Office, the disclosure of which is incorporated herein by reference.

BACKGROUND

1. Field

Embodiments of the present invention relate to a refrigerator equipped with an ice maker that moves ice from an ice making recess using an ejector, and a control method thereof.

2. Description of the Related Art

Generally, a refrigerator is an apparatus including parts constituting a freezing cycle to generate a cold air and refrigerate or freeze objects stored in the refrigerator by the cold air. In some refrigerators recently developed, a refrigerating chamber having a relatively higher frequency of use is disposed at an upper part of a refrigerator body while a freezing chamber having a relatively lower frequency of use is disposed at a lower part of the refrigerator body.

In addition, such a refrigerator is provided with a dispenser enabling a user to withdraw water and ice from the outside without having to open a door of the refrigerator. An ice maker is formed at one side of the refrigerating chamber to make ice to be withdrawn through the dispenser. Also, an ice feeder is formed at a lower part of the ice maker to store the ice made and supplied by the ice maker and feed the ice to the dispenser when withdrawal of the ice is required. An ice making chamber is partitioned from the refrigerating chamber by the existence of the ice feeder.

The ice maker includes an ice making tray in which water is supplied and frozen, an ejector rotated by an ice making motor which generates a rotative force to thereby separate the ice made in the ice making tray from the ice making tray, and an ice full state sensing lever pivotably mounted to one side of the ice making tray by one end thereof so as to determine an ice full state wherein an ice storage is filled with the ice by a predetermined quantity and suspend the operation of the ice maker if the ice storage is in the ice full state.

The ice feeder includes the ice storage receiving and storing the ice falling from the ice maker disposed above, being equipped with an outlet to discharge the ice to be withdrawn through the dispenser, and an auger having a screw form being rotatably mounted in the ice storage. The auger is rotated by a feeding motor that generates a rotative force, thereby feeding the ice toward the outlet.

SUMMARY

Therefore, it is an aspect of the present invention to provide a refrigerator which controls an ice making motor to detect an ice full state without moving ice made in an ice maker, and a control method thereof.

Additional aspects of the invention will be set forth in part in the description which follows and, in part, will be apparent from the description, or may be learned by practice of the invention.

In accordance with one aspect, a control method of a refrigerator includes checking whether an ice storage is in an ice full state by rotating a ice making motor of an ice maker in an ice moving direction, and checking whether the ice full state is released by rotating the ice making motor in the opposite direction to the ice moving direction if the ice storage is in the ice full state.

The checking of the ice full state may be performed by driving an ice full state sensing lever mounted to the ice maker by rotating the ice making motor in the ice moving direction.

The ice full state sensing lever may be driven when the ice making motor is rotated in the ice moving direction by at least a predetermined angle.

The checking of release of the ice full state may be performed by driving the ice full state sensing lever mounted to the ice maker by rotating the ice making motor in the opposite direction to the ice moving direction.

The ice full state sensing lever may be driven when the ice making motor is rotated in the opposite direction to the ice moving direction by at least a predetermined angle.

The checking of release of the ice full state may be performed by rotating the ice making motor in the opposite direction to the ice moving direction and thereby periodically checking whether the ice full state is released.

According to another aspect, a control method for a refrigerator may include checking whether power of the refrigerator is turned to an on state from an off state, and detecting an ice full state of an ice storage when the power is turned on, by rotating an ice making motor in an opposite direction to a direction of the ice making motor to move ice from an ice maker of the refrigerator to the ice storage.

When it is determined that the ice storage is in the ice full state, the ice making motor may be driven periodically to check whether the ice full state is released.

The control method may further include checking possibility of ice moving by the ice maker when it is determined that the ice storage is not in the ice full state.

The ice moving possibility may be checked according to whether temperature of an ice making tray mounted to the ice maker is lower than a predetermined temperature.

The checking whether power of the refrigerator is turned on from the off state may include checking whether power is initially applied to the refrigerator or whether the refrigerator recovers from power failure.

In accordance with another aspect, a refrigerator includes an ice making tray making ice therein, an ejector separating the ice, an ice storage storing the separated ice, an ice full state sensing lever detecting the ice full state of the ice storage, an ice making motor driving the ejector and the ice full state sensing lever, and a controller detecting the ice full state of the ice storage by driving the ice full state sensing lever by rotating the ice making motor in an ice moving direction, and checking whether the ice full state is released by driving the ice full state sensing lever by rotating the ice making motor in the opposite direction of the ice moving direction if the ice full state is detected.

The ice full state sensing lever may be mounted to one side of the ice making tray to be pivoted up and down.

The controller periodically may check whether the ice full state is released if the ice storage is determined to be in the ice full state.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION OF EMBODIMENTS

Figure 1:
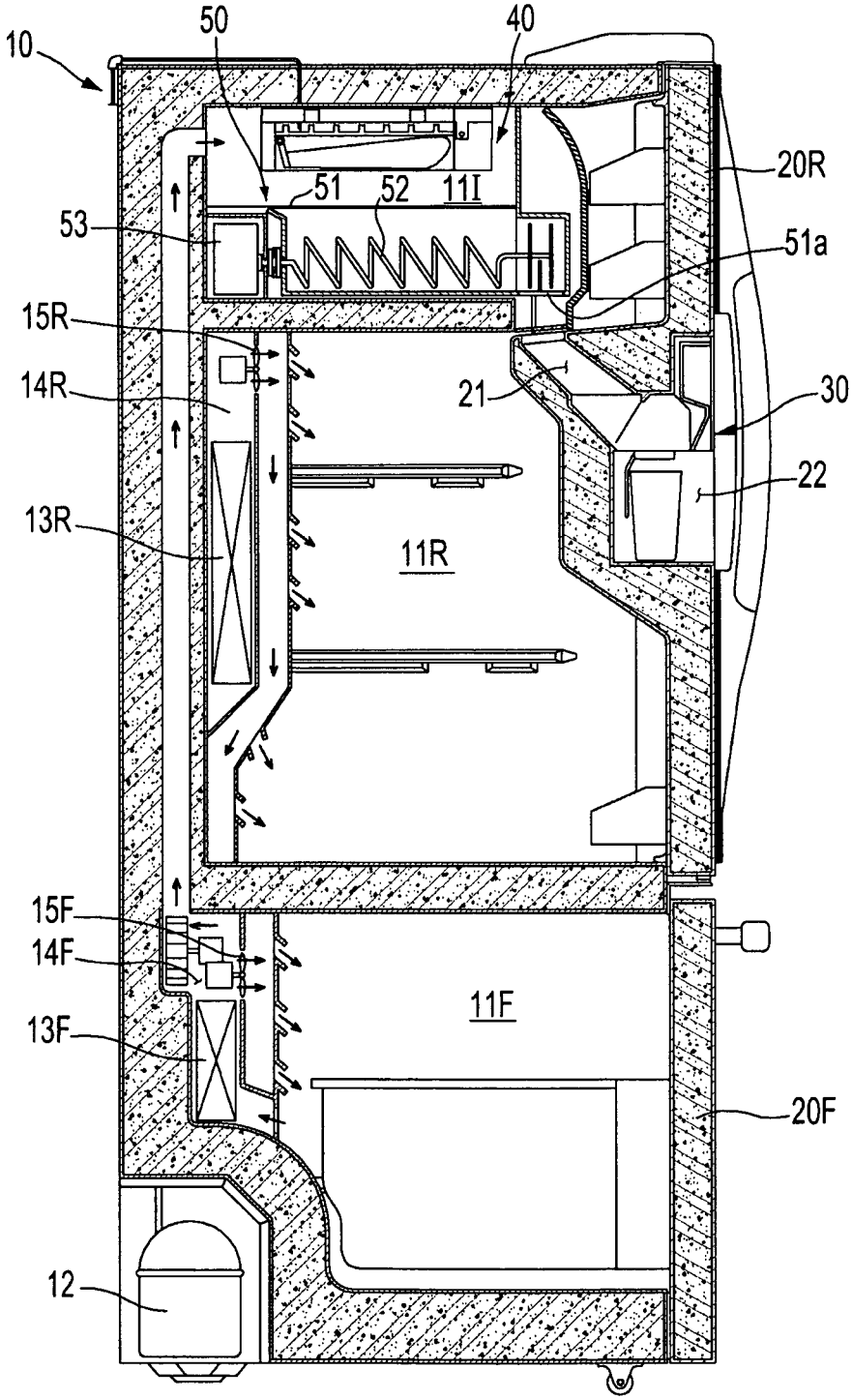
FIG. 1 is a sectional view schematically showing the structure of a refrigerator according to an embodiment.

Reference will now be made in detail to the embodiments of the present invention, examples of which are illustrated in the accompanying drawings, wherein like reference numerals refer to the like elements throughout.

FIG. 1 is a sectional view showing the structure of a refrigerator according to an embodiment.

Referring to FIG. 1, the refrigerator includes a main body 10 provided with storage chambers 11R and 11F storing food therein, and doors 20R and 20F hinged on one side of the main body 10 to respectively open and close the storage chambers 11R and 11F.

The storage chambers 11R and 11F are divided by a middle partition into upper and lower parts, that is, a refrigerating chamber 11R disposed at the upper part to store food in a refrigerating manner and a freezing chamber 11F disposed at the lower part to store food in a freezing manner. The doors 20R and 20F are divided into a refrigerating chamber door 20R opening and closing the refrigerating chamber 11R and a freezing chamber door 20F opening and closing the freezing chamber 11F, such that the refrigerating chamber 11R and the freezing chamber 11F are independently opened and closed.

A compressor 12 to compress refrigerant is mounted at a rear lower part of the main body 10. A refrigerating evaporator chamber 14R and a freezing evaporator chamber 14F are partitioned at rear parts of the refrigerating chamber 11R and the freezing chamber 11F, respectively, to generate cold air to be supplied to the refrigerating chamber 11R and the freezing chamber 11F. Additionally, a refrigerating circulation fan 15R and a freezing circulation fan 15F are formed in the refrigerating evaporator chamber 14R and the freezing evaporator chamber 14F, respectively. The circulation fans 15R and 15F generate a suction force and a ventilation force by rotating and thereby circulate the cold air generated from the refrigerating evaporator 13R and the freezing evaporator 13F through the refrigerating evaporator chamber 14R and the freezing evaporator chamber 14F, respectively.

The refrigerator further includes a dispenser 30 mounted to the refrigerating chamber door 20R to enable withdrawal of water and ice stored in the refrigerating chamber without opening of the refrigerating chamber door 20R, an ice maker 40 making the ice to be withdrawn through the dispenser 30, and an ice feeder 50 disposed at a lower part of the ice maker 40 to store the ice made and supplied by the ice maker 40 and feed the ice to the dispenser 30 when withdrawal of the ice is required. An ice making chamber 111 including the ice maker 40 and the ice feeder 50 is partitioned at one side in the refrigerating chamber 11R in such a manner that the ice maker 40 is mounted at an upper part of the ice making chamber 111 and the ice feeder 50 is mounted at a lower part of the ice making chamber 111.

The refrigerating chamber door 20R includes a discharge guiding pipe 21 fluidly communicated with the ice making chamber 111 when the refrigerating chamber 11R is closed by the refrigerating chamber door 20R so as to guide discharge of ice made in the ice maker 40 and enable a user to withdraw the ice without opening the refrigerating chamber door 20R. In addition, an ice discharging part 22 is formed on a front side of the refrigerating chamber door 20R, being depressed inward to conveniently receive the ice being discharged through the discharge guiding pipe 21.

Figure 2:
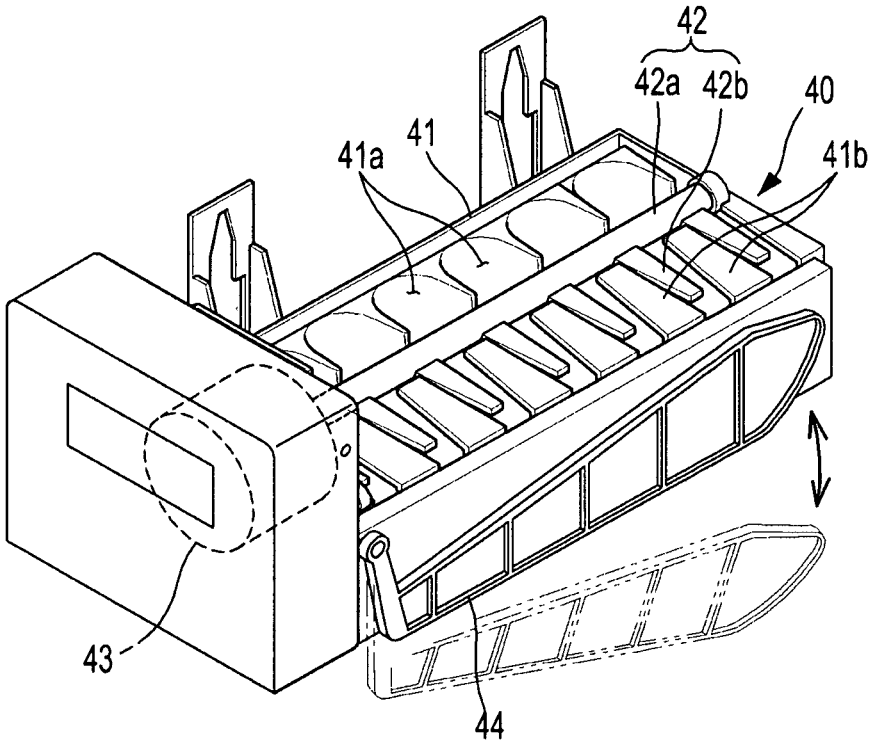
FIG. 2 is a perspective view of an ice maker adopted in the refrigerator according to the embodiment.
Figure 3:
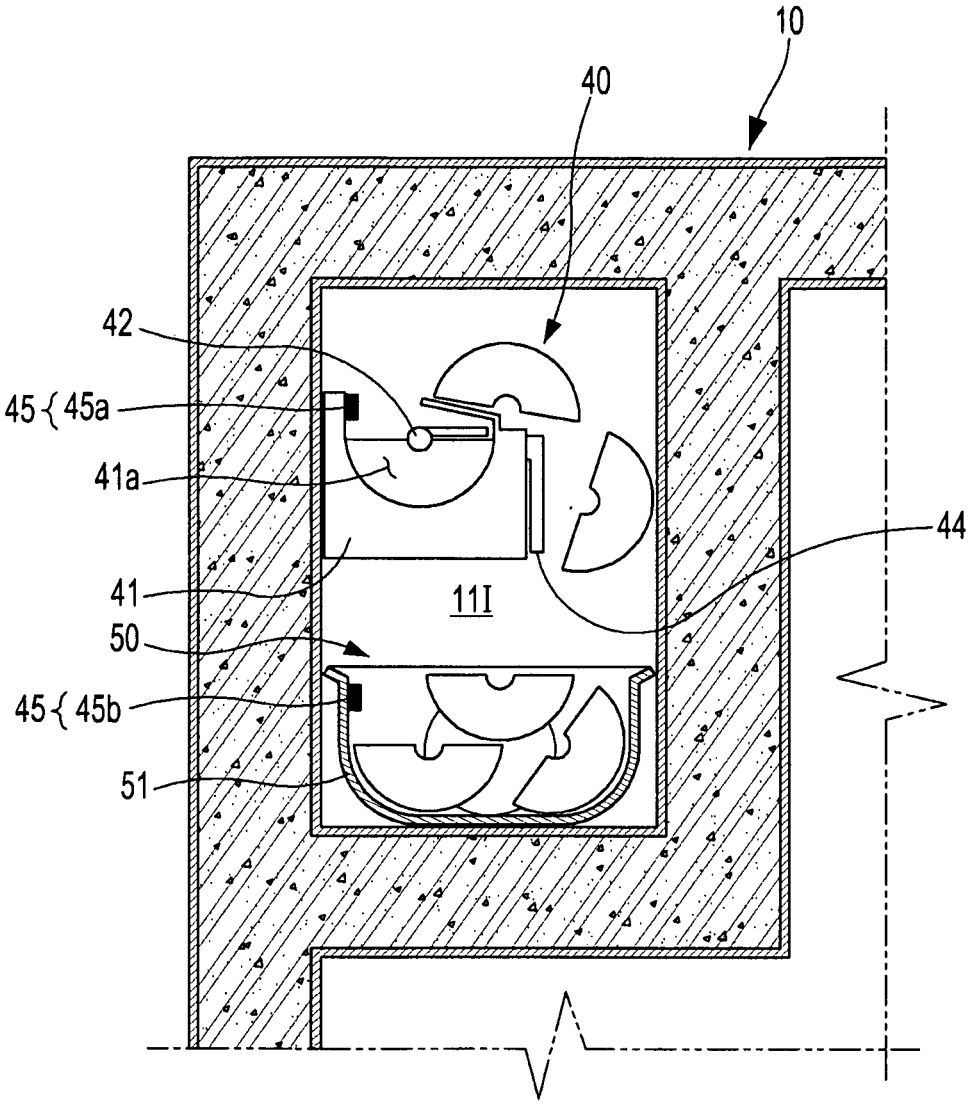
FIG. 3 is a sectional view schematically showing the structure of the ice maker according to the embodiment.

FIG. 2 is a perspective view of an ice maker adopted in the refrigerator according to the embodiment of the present invention. FIG. 3 is a sectional view schematically showing the structure of the refrigerator.

As shown in FIG. 2, the ice maker 40 includes an ice making tray 41 in which water is supplied and frozen, an ejector 42 rotatably mounted to move the ice made in the ice making tray 41 as rotating, and an ice making motor 43 mounted to both longitudinal ends of the ejector 42 to rotate the ejector 42.

The ice making tray 41 includes ice making recesses 41*a* formed therein into a substantially semicircular cylinder shape with an opened upper side, and a plurality of guide bars 41*b* disposed at one side of the ice making tray 41 to cover one upper side of the respective ice making recesses 41*a* so that the ice separated by the ejector 42 is guided to the ice feeder 50 disposed below. In addition, although not shown, a heater is built in the lower part of the ice making tray 41 to apply heat to the ice making tray 41 and thereby facilitate separation of the ice.

The ejector 42 is extended in a forward and backward direction. The ejector 42 includes a rotational shaft 42*a* connected to the ice making motor 43 with one end thereof and rotated by the ice making motor 43, and a plurality of ejector pins 42*b* extended outward from the rotational shaft 42*a* in radial directions and rotated to move the ice made in the ice making tray 41 along inner surfaces of the respective ice making recesses 41*a* having the substantially semicircular cylinder form, and thereby separate the ice. Here, a rotational direction of the ice making motor 43 to move the ice to the ice storage 51 will now be referred to as an "ice moving direction."

As shown in FIG. 1, the ice feeder 50 includes the ice storage 51 receiving and storing the ice falling from the ice maker 40 disposed above, and including an outlet 51*a* to discharge the ice to be withdrawn through the dispenser 30, and an auger 52 having a screw form, being rotatably mounted in the ice storage 51 to feed the ice toward the outlet 51*a* as rotating, and a feeding motor 53 generating a rotative force to rotate the auger 52.

Furthermore, the ice maker 40 applied to the refrigerator according to the embodiment is provided with an ice full state sensing lever 44 to determine whether the ice storage 51 is in an ice full state by being filled with ice by a predetermined quantity. More specifically, the ice full state sensing lever 44 is mounted to one side of the ice making tray 41 and measures height of the ice in the ice storage 51 as pivoting up and down. The operation of the ice maker 40 is switched on and off according to the height of the ice measured by the ice full state sensing lever 44.

Figure 4:
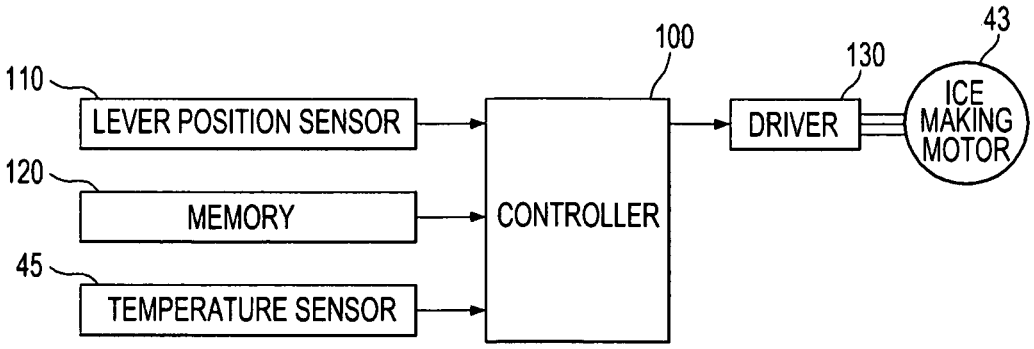
FIG. 4 is a control block diagram of the ice maker according to the embodiment.

FIG. 4 is a control block diagram of the ice maker according to the embodiment.

As shown in FIG. 4, the ice maker 40 includes a lever position sensor 110 perceiving the position of the ice full state sensing lever 44, a memory 120 storing information on an ice full state sensing period and an ice moving period of the ice maker 40, temperature sensors 45 measuring the temperature of the ice making tray 41 and the ice storage 51, a controller 100 controlling the operation of the ice maker 40 in accordance with the position of the ice full state sensing lever 44, the ice full state sensing period, and the temperature of the ice making tray 41, and a driver 130 rotating the ice making motor 43 to operate the ejector 42 and the ice full state sensing lever 44.

The lever position sensor 110 perceives the position of the ice full state sensing lever 44. That is, when the ice making motor 43 is rotated by a predetermined angle, for example about 45 degrees, clockwise or counterclockwise to detect the ice full state of the ice storage 51, the ice full state sensing lever 44 is lowered and the lever position sensor 110 perceives the lowered distance of the ice full state sensing lever 44. When the lowered distance of the ice full state sensing lever 44 is perceived to be shorter than a predetermined reference distance stored in the memory 120, it is determined that the ice storage 51 is in the ice full state. The reference distance may be optionally set by a designer, as a distance by which the ice full state sensing lever 44 is movable when the ice storage 51 is determined to be in the ice full state being filled with the ice by the predetermined quantity.

The memory 120 stores the information on the reference distance explained above, the ice full state sensing period and the ice moving period denoting a period of moving the ice from the ice maker 40 to the ice storage 51.

A temperature sensor 45*a* of the temperature sensors 45 measures temperature of the ice making tray 41 to check whether water supplied to the ice making recesses 41*a* turns to ice. Presuming that the water in the ice making recesses 41*a* turns to ice at a predetermined temperature of the ice making tray 41, generation of the ice may be determined by checking whether the temperature of the ice making tray 41 becomes the predetermined temperature. Here, the predetermined temperature may be experimentally set. The temperature sensor 45*a* may be mounted to an inner wall of the ice making recesses 41*a* to directly measure the temperature of the supplied water.

Another temperature sensor 45*b* may be mounted on the inside of the ice storage 51 to measure temperature of the ice storage 51.

When the height of the ice in the ice storage 51 is measured using the lever position sensor 110, the controller 100 controls the operation of the ice maker 40 according to the measured height. More particularly, when the ice storage 51 is determined to be in the ice full state, the controller 100 suspends the operation of the ice maker 40 so that the ice moving is not performed. On the other hand, when it is determined that the ice storage 51 is not in the ice full state, the controller 100 controls the ice maker 40 to perform the ice moving according to the determined information.

Also, the controller 100 checks whether the ice storage 51 is in the ice full state by rotating the ice making motor 43 clockwise, and continues the ice moving when the ice storage 51 is determined to be not in the ice full state. However, when the ice storage 51 is determined to be in the ice full state, the controller 100 suspends the ice moving and returns the ice making motor 43 to its initial position. In addition, the controller 100 rotates the ice making motor 43 counterclockwise periodically to detect the ice full state again. That is, when the ice storage 51 is determined to be in the ice full state, whether the ice full state is released may be determined by rotating the ice making motor 43 counterclockwise. Accordingly, a process of moving of the ice made in the ice making recesses 41*a* may not be performed to detect the ice full state.

More specifically, when the ice making motor 43 is rotated, the ejector 42 and the ice full state sensing lever 44 are operated in association with each other. In case that the ice making motor 43 is rotated clockwise by a predetermined angle, for example 45 degrees, to drive the ice full state sensing lever 44, the ejector pins 42*b* come to push the ice out unnecessarily. Furthermore, in order to move the ice from the ice maker 40, an additional process used to be necessitated to facilitate movement of the ice by applying heat to the ice making tray 41 using the heater (not shown) installed at the lower part of the ice making tray 41. Thus, two unnecessary processes, that is, the ice heating process and the ice moving process, are performed to detect the ice full state. According to the embodiment, however, once the ice full state of the ice storage 51 is detected by the clockwise rotation of the ice making motor 43, the ice making motor 43 is rotated counterclockwise so that the ejector pins 42*b* are rotated to the empty space when checking the ice full state again. As a result, the heating and the ice moving that used to be unnecessarily performed may be omitted.

The driver 130 rotates the ice making motor 43, thereby driving the ejector 42 and the ice full state sensing lever 44 in association with each other. When the ice making motor 43 is rotated, the ejector 42 is rotated in the same direction as the ice making motor 43. As the ice making motor 43 rotates clockwise or counterclockwise by the predetermined angle, for example 45 degrees, the ice full state sensing lever 44 is vertically moved downward.

Figure 5A:
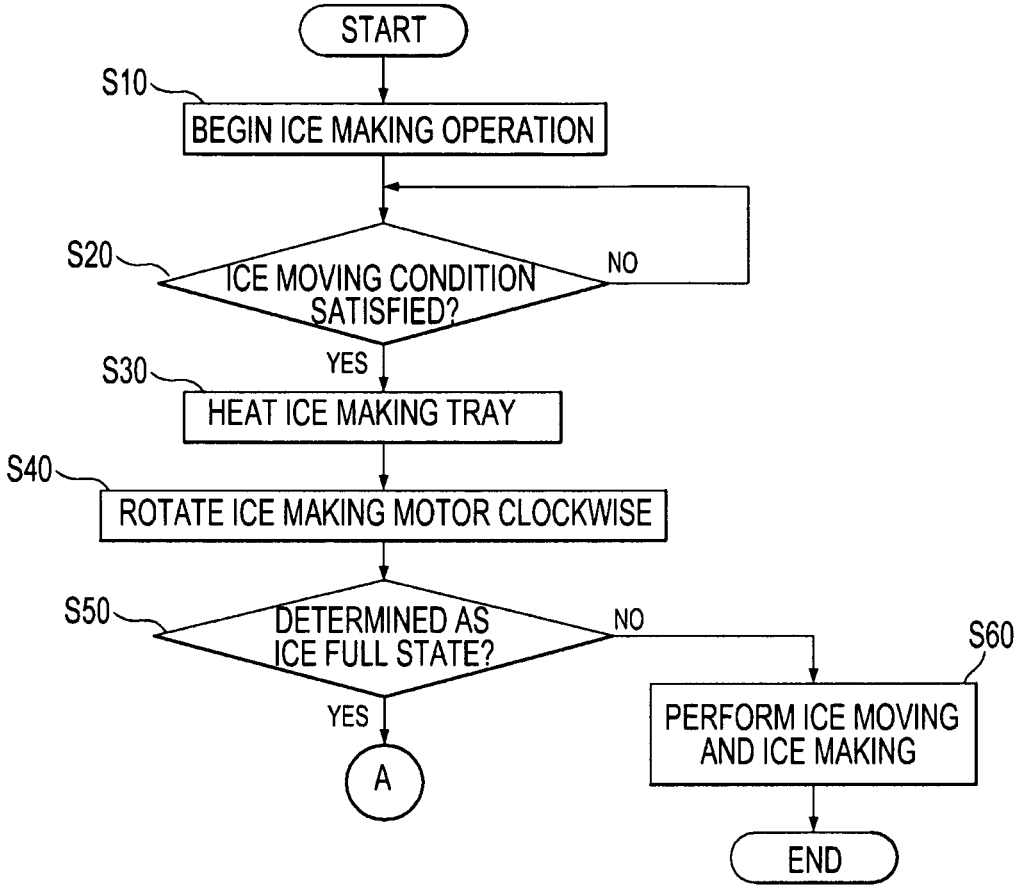
FIG. 5A and FIG. 5B are control flowcharts of the ice maker according to the embodiment.
Figure 5B:
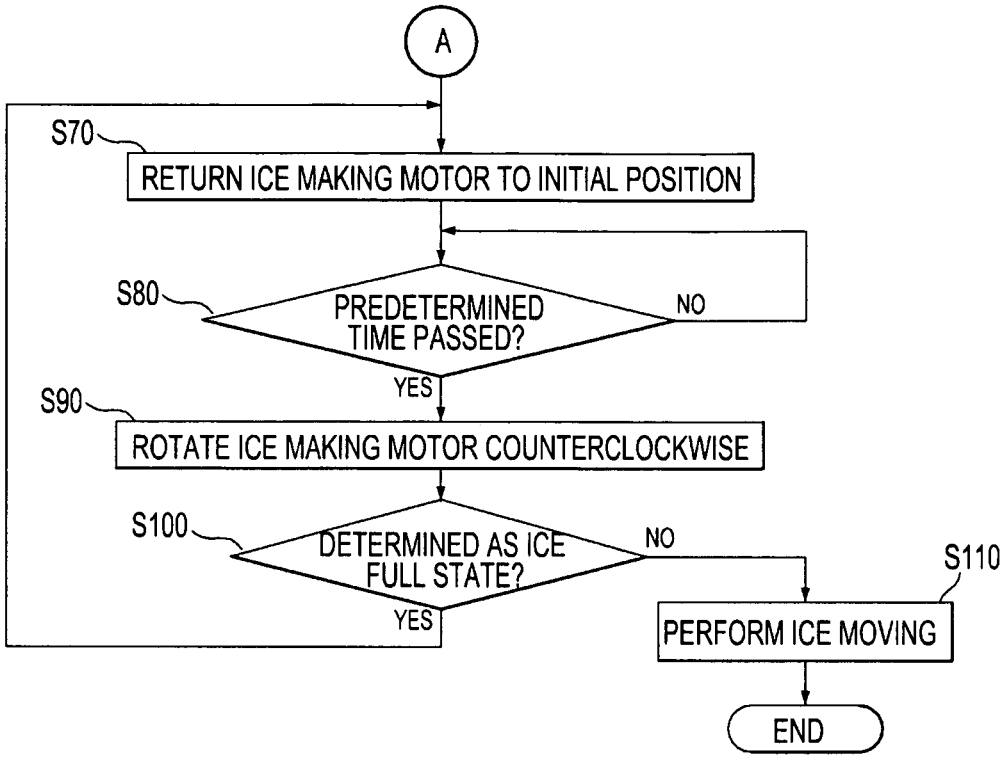

FIG. 5A and FIG. 5B are control flowcharts of the ice maker 40 according to the embodiment of the present invention.

As shown in FIG. 5A, the ice maker 40 begins an ice making operation. That is, the ice maker 40 supplies water to the ice making tray 41 and decreases the temperature of the ice making tray 41 to turn the water into ice (operation S10).

Next, after beginning the ice making operation, it is determined whether the ice making device 40 satisfies an ice moving condition. The ice moving condition may be satisfied when the ice making tray 41 reaches an ice making temperature and the ice moving period, that is, a time interval from the last ice moving time, stored in the memory 120 has passed (operation S20)

When it is determined that the ice moving condition is satisfied, the ice making tray 41 is heated by the heater (not shown) disposed at the lower part of the ice making tray 41 so as to enhance the ice moving efficiency (operation S30).

Next, the ice making motor 43 is rotated in the ice moving direction, that is, clockwise to thereby operate the ejector 42 and the ice full state sensing lever 44 operating in association with each other. Accordingly, the ice made in the ice making tray 41 is rotated by the ejector 42 by the predetermined angle toward the ice storage 51. The ice full state sensing lever 44 measures the height of the ice received in the ice storage 51, thereby perceiving the quantity of the ice (operation S40).

After that, the controller 100 detects the ice full state through the ice full state sensing lever 44 driven by rotation of the ice making motor 43 in the ice moving direction which is the clockwise direction. To be specific, the lever position sensor 110 perceives the lowered distance of the ice full state sensing lever 44 and then, if the lowered distance is perceived to be shorter than the reference distance stored in the memory 120, it is determined that the ice storage 51 is in the ice full state (operation S50). Here, the reference distance may be optionally set by the designer as a distance by which the ice full state sensing lever 44 is movable when the ice storage 51 is determined to be in the ice full state being filled with the ice by the predetermined quantity.

Next, when the ice storage 51 is determined to be not in the ice full state in operation 50, the ice moving that separates and moves the ice from the ice making tray 41 to the ice storage 51 and the ice making that makes the ice through the water supply are performed (operation S60).

On the other hand, when it is determined in operation 50 that the ice storage 51 is in the ice full state, the ice making motor 43 does not perform the ice moving and rotates counterclockwise, thereby returning to its initial position. The processes afterward will be explained with reference to FIG. 5B.

As shown in FIG. 5B, when it is determined in operation 50 that the ice storage 51 is in the ice full state, the ice making motor 43 returns to its initial position (operation S70).

Next, the controller 100 checks whether the predetermined time stored in the memory 120 has passed. The memory 120 stores the ice full state sensing period input by the designer and checks by the predetermined period whether the ice full state is released (operation S80).

When it is determined that the predetermined period has passed after the ice full state is first perceived, the ice making motor 43 is rotated in the opposite direction to the ice moving direction, that is, counterclockwise. When the ice making motor 43 rotates in the opposite direction, the ejector 42 and the ice full state sensing lever 44 are driven in association with each other. Here, more specifically, if the ice making motor 43 is rotated in the ice moving direction, that is, clockwise to drive the ice full state sensing lever 44, the ejector pins 42*b* come to push the ice out unnecessarily. To this end, the ice making motor 43 is rotated in the opposite direction to the ice moving direction, that is, counterclockwise when checking the ice full state again (operation S90). Thus, since the ejector pins 42*b* are rotated to the empty space by the counterclockwise rotation of the ice making motor 43, the heating and the ice moving that used to be unnecessarily performed to check the ice full state may be omitted.

After the ice full state is checked through the counterclockwise rotation of the ice making motor 43, when it is determined that the ice full state is not released, it returns to operation 70 (operation S100).

If it is determined that the ice full state is released, on the other hand, the ice moving is performed (operation S110).

Figure 6:
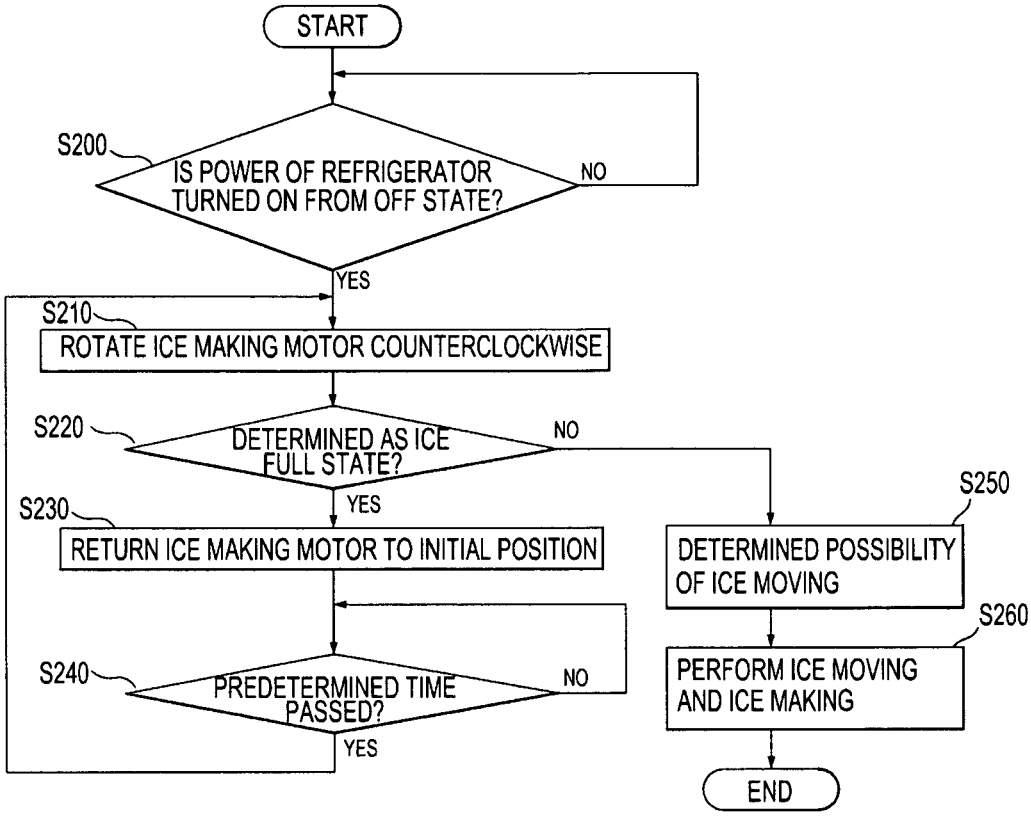
FIG. 6 is a control flowchart of the ice maker showing the operation of when power is initially applied or when power failure is recovered.

FIG. 6 is a control flowchart of the ice maker showing the operation of when power is initially applied or when it recovers from power failure.

As shown in FIG. 6, the controller 100 checks whether the refrigerator is powered on from an off state. In other words, the controller 100 checks whether power of the refrigerator is turned from the off state to the on state by initial application of power or by recovery from power failure (operation S200).

When it is determined that power of the refrigerator is turned on from the off state, the ice making motor 43 is rotated counterclockwise to detect the ice full state of the ice storage (operations S210 and S220).

Next, when it is determined that the ice storage 51 is in the ice full state, the ice making motor 43 is returned to its initial position and then it returns to operation S210 in order to detect the ice full state again by the period stored in the memory 120 (operation S230 and S240).

When it is determined that the ice storage 51 is not in the ice full state, whether the ice moving is practicable by the ice maker 40 is determined. Here, it may be determined that the ice moving is practicable when water is supplied in the ice making tray 41 and ice is made by the decrease of temperature of the supplied water (operation S250).

The ice making and the ice moving are properly performed according to the determination result of operation S250. In other words, if the ice making tray 41 lacks water, ice is made by supplying water. If ice is not made although water is supplied in the ice making tray 41, the ice making is performed. If there is made ice in the ice making tray 41, the ice is moved to the ice storage 51 (operation S260).

In the above description, the ice moving direction refers to a rotational direction of the ice making motor 43 to move the ice from the ice making tray 41 to the ice storage 51 while the opposite direction refers to a direction opposite to the ice moving direction.

According to a refrigerator and a control method thereof according to the above-described embodiments, after an ice full state of an ice storage of the refrigerator is detected, an ice making motor is rotated in the opposite direction to a rotational direction for movement of ice, thereby releasing the ice full state of the ice storage repeatedly. Accordingly, a process to move the ice within the ice maker may not be performed to check the ice full state, thereby reducing consumption of energy.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A control method for a refrigerator comprising an ice maker having an ejector to move ice from an ice making tray, an ice full state sensing lever to detect an ice full state in an ice storage, and an ice making motor allowing the ejector to interact with the ice full state sensing lever and configured to rotate the ice making motor in a first direction and a second direction, the control method comprising:

allowing the ejector to perform an ice moving operation by moving the ice making motor of the ice maker in the first direction, and checking whether the ice storage is in an ice full state through a driving of the ice full state sensing lever; and if the ice storage is in the ice full state, allowing the ejector to stop the ice moving operation by rotating the ice making motor of the ice maker in the second direction opposite to the first direction, and checking whether the ice full state of the ice storage is released, through a driving of the ice full state sensing lever.

2. The control method for a refrigerator according to claim 1, wherein the ice full state sensing lever is driven when the ice making motor is rotated in the first direction by a predetermined angle or above.

3. The control method for a refrigerator according to claim 1, wherein the ice full state sensing lever is driven when the ice making motor is rotated in the second by a predetermined angle or more.

4. The control method for a refrigerator according to claim 1, wherein the checking of release of the ice full state comprises periodically checking release of the ice full state by rotating the ice making motor in the second direction.

5. A control method for a refrigerator comprising an ice maker having an elector to move ice from an ice making tray, an ice full state sensing lever to detect an ice full state of an ice storage, and an ice making motor allowing the elector to interact with the ice full state sensing lever, the control method comprising:

checking whether power of the refrigerator is turned to an on state from an off state; and if checked that the power is turned on, allowing the ejector to stop an ice moving operation by rotating the ice making motor of the ice maker in an opposite direction to a rotating direction of the ice making motor at the time of the ice moving operation, and checking an ice full state of the ice storage through a driving of the ice full state sensing lever.

6. The control method for a refrigerator according to claim 5, wherein, when it is determined that the ice storage is in the ice full state, the ice making motor is driven periodically to check whether the ice full state is released.

7. The control method for a refrigerator according to claim 5, further comprising:

checking an ice moving practicability of the ice maker when it is determined that the ice storage is not in the ice full state.

8. The control method for a refrigerator according to claim 7, wherein the ice moving practicability is checked according to whether temperature of an ice making tray mounted to the ice maker is lower than a predetermined temperature.

9. The control method for a refrigerator according to claim 5, wherein the checking whether power of the refrigerator is turned on from the off state comprises:

checking whether power is initially applied to the refrigerator or whether the refrigerator recovers from power failure.

10. A refrigerator comprising:

an ice making tray configured to generate ice therein;

an ejector configured to move the ice;

an ice storage configured to store the moved ice;

an ice full state sensing lever configured to sense an ice full state of the ice storage;

an ice making motor allowing the ejector if checked that the power is turned on, allowing the ejector to stop an ice moving operation by rotating the ice making motor of the ice maker in an opposite direction to a rotating direction of the ice making motor at the time of the ice moving operation, and checking an ice full state of the ice storage through a driving of the ice full state sensing lever; and a controller configured to allow the ejector to perform an ice moving operation by moving the ice making motor in the first direction, configured to check an ice full state of the ice storage through a driving of the ice full state sensing lever, and if the ice storage is in an ice full state, configured to allow the ejector to stop the ice moving operation by rotating the ice making motor in the second direction opposite to the first direction, and configured to check a release of the ice full state of the ice storage through the driving of the ice full state sensing lever.

11. The refrigerator according to claim 10, wherein the ice full state sensing lever is mounted to one side of the ice making tray to be pivoted up and down.

12. The refrigerator according to claim 10, wherein the controller periodically checks whether the ice full state is released if the ice storage is determined to be in the ice full state.

* * * * *

UNITED STATES PATENT AND TRADEMARK OFFICE

CERTIFICATE OF CORRECTION

PATENT NO. : 8,499,572 B2
APPLICATION NO. : 12/654629
DATED : August 6, 2013
INVENTOR(S) : Jae Hoon Lim et al.

It is certified that error appears in the above-identified patent and that said Letters Patent is hereby corrected as shown below:

On the Title Page, In Column 1 (Inventors), Line 4, Delete "Gurl-si" and insert -- Guri-si --, therefor.
In the Claims
Column 8, Line 47, In Claim 3, after "second" insert -- direction --.
Column 8, Line 54, In Claim 5, delete "elector" and insert -- ejector --, therefor.
Column 8, Line 56, In Claim 5, delete "elector" and insert -- ejector --, therefor.

Signed and Sealed this
Eighteenth Day of February, 2014

Michelle K. Lee

Michelle K. Lee
*Deputy Director of the United States Patent and Trademark Office*